US006216566B1

(12) United States Patent
Zurbuchen

(10) Patent No.: US 6,216,566 B1
(45) Date of Patent: Apr. 17, 2001

(54) INSULATING COMPOSITE BREAKER BAR

(75) Inventor: Gregory A. Zurbuchen, Kenosha, WI (US)

(73) Assignee: Snap-on Tools Company, Kenosha, WI (US)

( * ) Notice: Subject to any disclaimer, the term of this patent is extended or adjusted under 35 U.S.C. 154(b) by 0 days.

(21) Appl. No.: 09/421,513

(22) Filed: Oct. 20, 1999

(51) Int. Cl.[7] ..... B25B 23/16

(52) U.S. Cl. ..... 81/177.8; 81/177.1; 81/900; 81/177.9

(58) Field of Search ..... 81/177.8, 177.7, 81/177.2, 900, 177.9, 177.75, 177.1, 180.1, 184

(56) References Cited

U.S. PATENT DOCUMENTS

| | | | | |
|---|---|---|---|---|
| 1,473,436 | * | 11/1923 | Leopold | 81/177.8 |
| 3,565,351 | | 2/1971 | Ross, Jr. . | |
| 3,613,753 | | 10/1971 | Wolf . | |
| 3,619,009 | | 11/1971 | O'Leary . | |
| 3,666,311 | | 5/1972 | McMullin . | |
| 4,165,771 | | 8/1979 | Curati, Jr. . | |
| 4,170,909 | * | 10/1979 | Wagner | 81/63.2 |
| 4,334,445 | * | 6/1982 | Timewell | 81/177 PP |
| 4,334,563 | | 6/1982 | Epel et al. . | |
| 5,095,783 | | 3/1992 | Majima . | |
| 5,259,277 | | 11/1993 | Zurbuchen . | |
| 5,263,389 | | 11/1993 | Frazzell et al. . | |
| 5,359,911 | | 11/1994 | Kruesi . | |
| 5,368,298 | | 11/1994 | You . | |
| 5,368,807 | | 11/1994 | Lindsay . | |
| 5,408,902 | | 4/1995 | Burnett . | |
| 5,421,931 | | 6/1995 | Carmien . | |
| 5,513,544 | * | 5/1996 | Winkler et al. | 74/547 |
| 5,526,774 | | 6/1996 | Swindall, Jr. et al. . | |
| 5,638,727 | | 6/1997 | Gringer . | |
| 5,657,674 | | 8/1997 | Burnett . | |
| 5,700,543 | | 12/1997 | Bendick et al. . | |
| 5,724,873 | | 3/1998 | Hillinger . | |
| 5,804,012 | | 9/1998 | Carmien . | |
| 5,904,077 | * | 5/1999 | Wright et al. | 81/177.9 |
| 6,016,726 | * | 1/2000 | Wright | 81/177.7 |

OTHER PUBLICATIONS

Armstrong Bros. Tool Co., 67.*

* cited by examiner

*Primary Examiner*—James G. Smith
*Assistant Examiner*—Hadi Shakeri
(74) *Attorney, Agent, or Firm*—Seyfarth Shaw

(57) ABSTRACT

A composite insulating breaker bar includes an elongated shaft formed of pultruded glass/polyester material, having a reduced end adhesively secured in an axial bore in a plastic handle, and a working end adhesively received in one end of a composite sleeve made of alternating layers of braided and longitudinal glass fibers in an epoxy resin matrix. Press-fitted in the other end of the sleeve is a swivel yoke insert including a knurled body and a pivoting square drive lug, pivotal movement of the square drive being accommodated by a diametral slot formed axially in the distal end of the sleeve.

17 Claims, 2 Drawing Sheets

INSULATING COMPOSITE BREAKER BAR

BACKGROUND OF THE INVENTION

The present invention relates to hand tools of the type which are relatively non-conducting electrically so that they can be safely used in applications where they may come into contact with sources of electrical power.

Various types of electrically insulated hand tools have been available for many years. Such tools typically include a standard metal shaft which, in addition to being connected to a handle which is formed of electrically insulating material, such as wood or plastic, is also coated or covered with an insulating material. Such insulated tools work acceptably well as long as the insulating covering is intact and in good condition. But, if the insulation becomes damaged, such a tool may be dangerous if it comes into contact with a source of electrical power, the danger being the risk of electrical shock to the user or inadvertent shorting of electrical circuits with which the shaft may come into contact. Therefore, such insulated tools are not recommended for use on live electrical wiring, contacts, or the like.

Certain types of tools with elongated shanks or shafts are formed of electrically insulating material. One such tool is disclosed, for example, in U.S. Pat. No. 5,259,277. But such prior tools do not have work-engaging portions which are designed to be movable in use relative to the shaft.

SUMMARY OF THE INVENTION

It is a general object of the invention to provide an improved composite hand tool which avoids the disadvantages of prior tools while affording additional structural and operating advantages.

An important feature of the invention is the provision of an electrically insulating hand tool which accommodates movement in use of a metal work-engaging portion, while minimizing exposure of electrically conducting portions.

Another feature of the invention is the provision of a hand tool of the type set forth, which is of relatively simple and economical construction.

Another feature of the invention is the provision of an electrically insulating breaker bar with a swivel square drive spinner.

In connection with the foregoing features, another feature of the invention is the provision of a hand tool of the type set forth, which affords the strength of a steel tool, while having significantly lower weight.

Certain ones of these and other features of the invention may be attained by providing a composite electrically insulating hand tool comprising: an elongated non-metallic shaft having a longitudinal axis and first and second ends, a non-metallic handle fixed to the first end of the shaft, an axial non-metallic receptacle at the second end of the shaft, and a plural-position, work-engaging mechanism fixedly received in the receptacle and projecting therefrom, the receptacle having a lateral opening therein to accommodate movement of the work-engaging mechanism to and from different use positions.

Other features of the invention may be attained by providing a hand tool of the type set forth, which includes a non-metallic sleeve receiving in one end thereof the second end of the shaft and receiving in the other end thereof the work-engaging mechanism, the lateral opening being formed in the sleeve.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
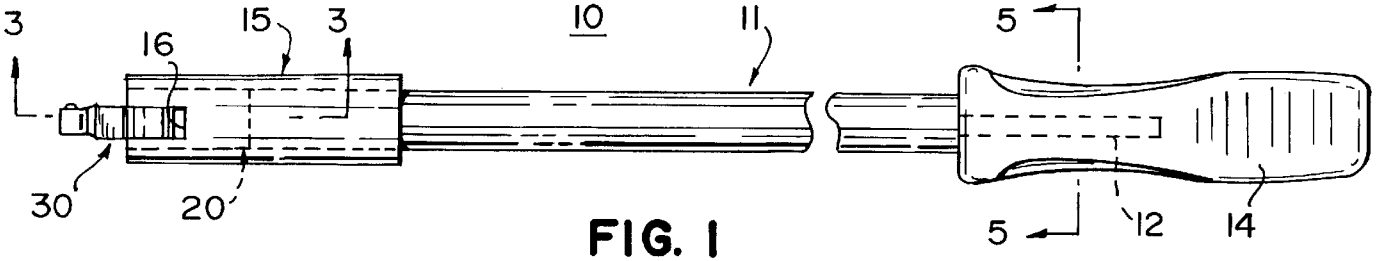
FIG. 1 is a side elevational view of a composite breaker bar constructed in accordance with and embodying the features of the present invention.
Figure 2:
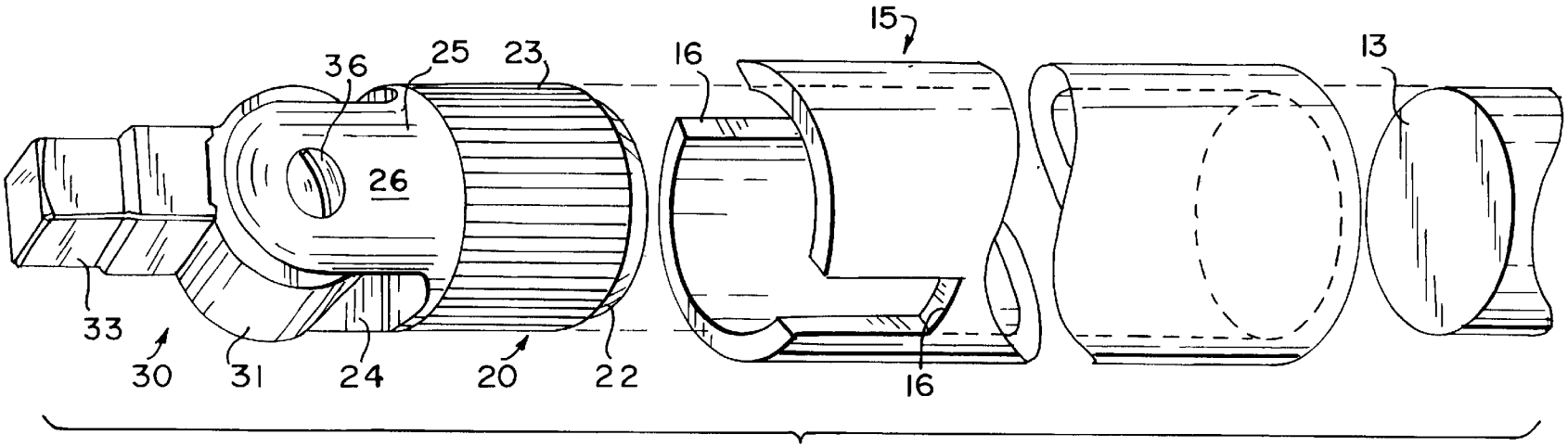
FIG. 2 is an enlarged, fragmentary, perspective, exploded view of the working end of the breaker bar of FIG. 1.

Referring to FIGS. 1–5, there is illustrated a breaker bar, generally designated by the numeral 10, constructed in accordance with the present invention. The breaker bar 10 has an elongated composite shaft 11 which is substantially cylindrical in shape, having a reduced-diameter end 12 and a working end 13. The reduced-diameter end 12 is received in a complementary axial bore in one end of an elongated handle 14. The working end 13 of the shaft 11 is coaxially received in one end of an elongated, hollow, tubular sleeve 15 formed of an electrically insulating material and having formed axially in the other or distal end thereof a slot 16, which extends diametrically thereacross.

The shaft 11 is preferably formed of a pultruded glass/polyester composite material. The handle 14 may be formed of a suitable electrically insulating plastic material. The reduced end 12 of the shaft 11 may be fixedly secured in the handle 14 and the working end 13 of the shaft 11 may be fixedly secured in the sleeve 15 by a suitable means, such as with an adhesive 17 (see FIGS. 3–5). The sleeve 15 is formed of a composite, electrically insulating material, preferably tubing made of alternating layers of braided (±45°) and longitudinally extending glass fibers in an epoxy resin matrix.

Figure 4:
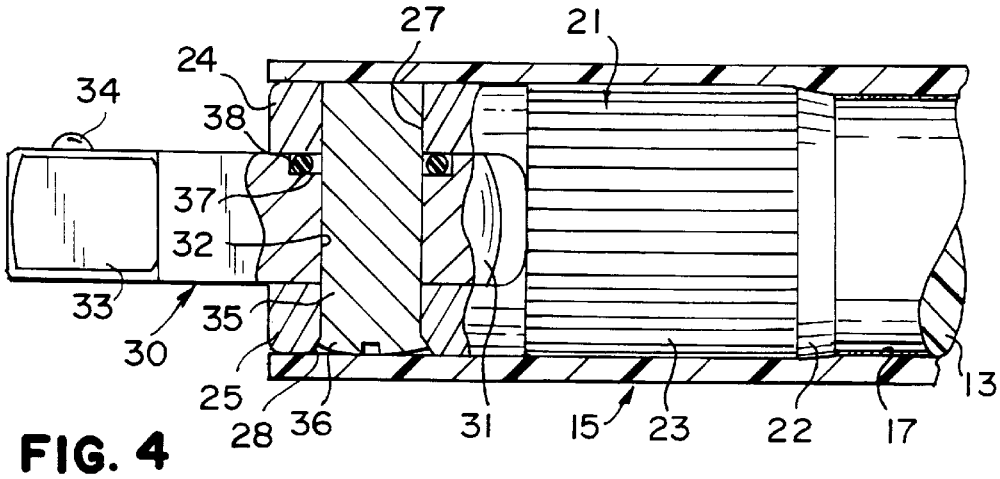
FIG. 4 is a sectional view taken generally along the line 4—4 in FIG. 3.
Figure 5:
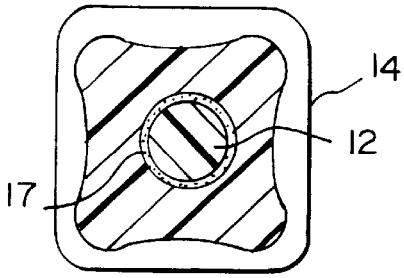
FIG. 5 is an enlarged view in vertical section taken generally along the line 5—5 in FIG. 1.

The breaker bar 10 also includes a work-engaging mechanism in the form of a swivel yoke 20, which has a substantially cylindrical barrel 21 provided with a chamfer 22 at one end thereof and having the cylindrical external surface thereof knurled, as at 23. The barrel 21 is dimensioned to be press-fitted in the slotted distal end of the sleeve 15 for fixedly securing the yoke 20 to the sleeve 15. The barrel 21 has a wide diametral slot formed axially therein at the forward end thereof, thereby forming a pair of clevis arms 24 and 25, each having a part-cylindrical outer surface 26. Formed through the clevis arms 24 and 25 diametrically of the barrel 21 is a bore 27 (FIG. 4) counterbored at one end thereof, as at 28 (FIG. 4). Preferably, the distal ends of the clevis arms 24 and 25 are rounded off along an arc coaxial with the bore 27.

Figure 3:
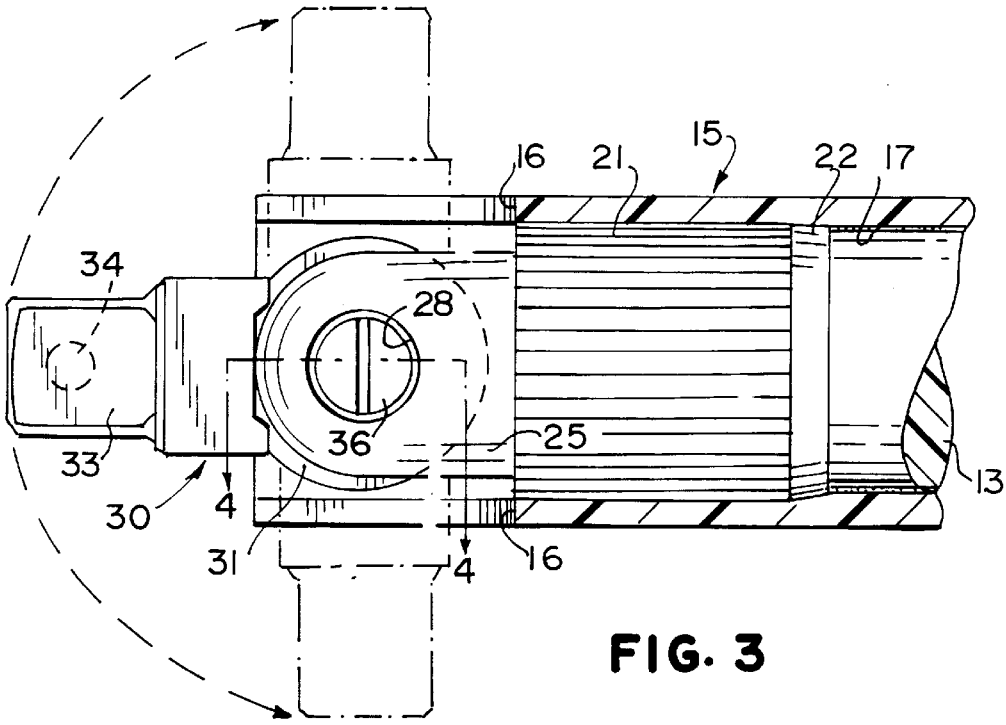
FIG. 3 is an enlarged, fragmentary, sectional view taken generally along the line 3—3 in FIG. 1 and illustrating in broken line alternative working positions of the tool.

The swivel yoke 20 also includes a square drive member 30 having a generally cylindrical hub 31 receivable between the clevis arms 24 and 25, the hub 31 having an axial bore 32 therethrough. Integral with the hub 31 and projecting radially therefrom is a square drive lug 33, having a detent ball 34 projecting from one side thereof in a known manner (FIGS. 3 and 4). The hub 31 is receivable in use between the clevis arms 24 and 25, with the bore 32 disposed in coaxial alignment with the bore 27 through the clevis arms 24 and 25 for receiving a pivot screw 35, having an enlarged slot head 36 receivable in the counterbore 28, as can best be seen in FIGS. 3 and 4. In this regard, the bore 27 may be internally threaded in the clevis arm 24 for threaded engagement with the screw 35. Formed in one side surface of the hub 31 coaxially around the bore 32 is an annular recess 37 receiving therein a friction O-ring 38 (see FIG. 4).

In use, the square drive member 30 is dimensioned for pivotal movement relative to the clevis arms 24 and 25 about the axis of the pivot screw 35 among a plurality of use positions, illustrated in FIG. 3. The O-ring 38 serves to frictionally inhibit pivotal movement of the square drive member 30 among its several positions, so as to effectively retain the square drive member 30 in a selected use position against accidental movement from that position, the frictional force being low enough to accommodate manual movement of the square drive member to a selected different use position. In the illustrated embodiment the square drive member 30 has three use positions, including an axially extending position illustrated in solid line in FIG. 3 and two laterally extending positions, illustrated in broken line in FIG. 3, respectively projecting from opposite sides of the sleeve 15 substantially perpendicular to the longitudinal axis of the shaft 11.

It will be appreciated that the slot 16 is dimensioned to permit pivoting or swiveling movement of the square drive member 30 among its several use positions while, at the same time, protecting the clevis arms 24 and 25 from contact with electrically live surfaces in the vicinity of use. Thus, it will be appreciated that the only electrically conducting part of the breaker bar 10 which is exposed in use is the work-engaging portion of the square drive member 30.

From the foregoing, it can be seen that the electrically insulating sleeve 15 provides a secure coupling between the working end of the shaft 11 and the swivel yoke 20, while accommodating swiveling movement of the yoke 20 and minimizing exposure of electrically conducting portions thereof.

While the swivel yoke 20 is preferably press-fitted in the sleeve 15, it will be appreciated that it could be fixedly secured by other means, such as a suitable adhesive. The insulating composite breaker bar 10 when used in conjunction with an associated socket tool, provides a means to apply high torque energies to associated fasteners in the vicinity of live electrical components, while minimizing any electrical hazard to the user of the components. Prototype constructional models of the breaker bar 10 have demonstrated both mechanical and dielectric strength values which exceed the applicable standards for such a tool. In particular, the breaker bar 10 has a mechanical strength comparable to that of a similarly-sized steel breaker bar.

From the foregoing, it can be seen that there has been provided an improved breaker bar which is electrically insulating, having no electrically conductive parts except for a work-engaging portion, and which accommodates movement of that work-engaging portion among different use orientations without adversely affecting the electrically insulating characteristics of the tool.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A composite electrically insulating hand tool comprising:

an elongated non-metallic shaft having a longitudinal axis and first and second ends, a non-metallic handle fixed to the first end of the shaft, an axial non-metallic receptacle at the second end of the shaft, and a plural-position, work-engaging mechanism fixedly received in the receptacle and projecting therefrom, said receptacle having a lateral opening therein to accommodate movement of the work-engaging mechanism to and from different use positions.

2. The hand tool of claim 1, wherein said handle is formed of a plastic material.

3. The hand tool of claim 1, wherein said shaft is formed of a glass/polyester material.

4. The hand tool of claim 1, wherein said work-engaging mechanism includes a swivel yoke pivotally movable among different positions.

5. The hand tool of claim 4, wherein said swivel yoke includes a drive lug movable among an axial position extending along the longitudinal axis and lateral positions extending substantially perpendicular to the longitudinal axis.

6. The hand tool of claim 4, wherein said yoke is press-fitted in said receptacle.

7. The hand tool of claim 1, wherein said lateral opening comprises a slot formed axially in the receptacle and extending diametrically thereacross.

8. The hand tool of claim 1, wherein the tool is a breaker bar, said work-engaging mechanism including a swivel square drive.

9. A composite electrically insulating hand tool comprising:

an elongated non-metallic shaft having a longitudinal axis and first and second ends, a non-metallic handle fixed to the first end of the shaft, a non-metallic sleeve fixed to the second end of the shaft and having a distal end projecting beyond the second end of the shaft, and a plural-position, work-engaging mechanism fixedly received in the distal end of the sleeve and projecting therefrom, said sleeve having a lateral opening therein to accommodate movement of the work-engaging mechanism to and from different use positions.

10. The hand tool of claim 9, wherein said handle is formed of a plastic material.

11. The hand tool of claim 9, wherein said shaft is formed of a glass/polyester material.

12. The hand tool of claim 9, wherein said sleeve is formed of a glass/epoxy material.

13. The hand tool of claim 12, wherein said sleeve is formed of alternate layers of braided and longitudinal glass fibers in an epoxy resin matrix.

14. The hand tool of claim 9, wherein said work-engaging mechanism includes a swivel yoke pivotally movable among an axial position extending along the longitudinal axis and lateral positions extending substantially perpendicular to the longitudinal axis.

15. The hand tool of claim 14, wherein said lateral opening comprising a slot formed axially in the receptacle and extending diametrically thereacross.

16. The hand tool of claim 14, wherein said yoke is press-fitted in said receptacle.

17. The hand tool of claim 9, wherein the tool is a breaker bar, said work-engaging mechanism including a swivel square drive.

* * * * *